251-48 SR
2/11/86 XR 4,569,803

United States Patent [19]

Takakura et al.

[11] Patent Number: 4,569,803

[45] Date of Patent: Feb. 11, 1986

[54] DASH POT DEVICE

[75] Inventors: Yoshinari Takakura, Toyota; Kazuhiko Kitamura, Nagoya, both of Japan

[73] Assignee: Aisin Seiki Kabushiki Kaisha, Kariya, Japan

[21] Appl. No.: 580,700

[22] Filed: Feb. 16, 1984

[30] Foreign Application Priority Data

Feb. 21, 1983 [JP]. Japan ..... 58-027440

[51] Int. Cl.[4] ..... F02M 19/12

[52] U.S. Cl. ..... 261/65; 261/DIG. 18; 251/48; 267/123; 55/385 F; 55/486

[58] Field of Search ..... 261/DIG. 18, 65; 55/385 F, 486; 267/123; 251/48

[56] References Cited

U.S. PATENT DOCUMENTS

| | | | |
|---|---|---|---|
| 2,657,037 | 10/1953 | Braun | 261/DIG. 18 |
| 2,675,093 | 4/1954 | McCall et al. | 55/486 |
| 3,081,847 | 3/1963 | Smitley | 261/DIG. 18 |
| 3,400,520 | 9/1968 | Sakurai | 55/528 |
| 3,670,708 | 6/1972 | Ojala | 261/DIG. 18 |
| 3,800,514 | 4/1974 | Avondoglio et al. | 55/486 |
| 3,907,944 | 9/1975 | Nakada | 261/DIG. 18 |
| 4,098,850 | 7/1978 | Tamura | 261/DIG. 18 |
| 4,328,207 | 12/1980 | Ruschke | 55/486 |

FOREIGN PATENT DOCUMENTS

| | | | |
|---|---|---|---|
| 50-12540 | 5/1975 | Japan . | |
| 52-66118 | 6/1977 | Japan | 261/DIG. 18 |

*Primary Examiner*—Tim Miles
*Attorney, Agent, or Firm*—Oblon, Fisher, Spivak, McClelland & Maier

[57] ABSTRACT

A dash pot device for application to a deceleration control system for delaying a return action to the engine idle speed position of a carburetor throttle valve for automobile engines. The device includes a body member having a partition wall dividing an interior of the body member into a diaphragm chamber and an air chamber, a diaphragm disposed within the diaphragm chamber, an air filter positioned within the air chamber, a shaft fastened to the diaphragm, a pinhole type orifice passage installed in the partition wall, and a check valve located in the partition wall and oriented parallel to the orifice passage.

7 Claims, 2 Drawing Figures

DASH POT DEVICE

BACKGROUND OF THE INVENTION

1. Field of the Invention

This invention relates to dash pot devices in general, and more particularly to a dash pot device applied to a deceleration control system of automobile engines.

2. Discussion of the Background

It is generally known that upon engine deceleration a great quantity of hydrocarbon(HC) and/or carbon oxidide(CO) gases are discharged owing to imperfect combustion and misfiring which are caused by a rich air-fuel ratio and a lowering of volumetric efficiency. Accordingly, there have been introduced several kinds of engine deceleration control devices which prevent HC,CO gases from being discharged from the engine. In a dash pot device, such being one of such devices, when a carburetor throttle valve returns to an engine idle speed portion on the engine deceleration, the return action of the throttle valve is delayed by means of a buffer action of a dash pot. Thus, the throttle valve gradually returns to the idle speed position to thereby prevent the occurrence of a rich air-fuel ratio and misfiring.

A conventional dash pot device is shown in Japanese Patent Publication No. 50(1975)-12540 wherein a labyrinth groove passage is used as a delay mechanism which delays the return action to the engine idle speed position of the throttle valve. The delay capacity of the labyrinth groove passage is much smaller than that of a pinhole type orifice passage. If the pinhole type orifice passage is used as the delay mechanism, however, loading of the pinhole orifice passage cannot be avoided. Furthermore, the above dash pot device includes an air filter so as to prevent foreign matter from entering into a diaphragm chamber. Since the air filter is positioned so as to be exposed to the atmosphere, it may be necessary to take into consideration the positioning direction of the dash pot so as to avoid loading of the air filter which is caused by muddy water within the engine compartment.

SUMMARY OF THE INVENTION

An object of the present invention is to eliminate the disadvantages of prior art dash pot devices.

Another object of the present invention is to provide a new and improved dash pot device wherein the delay capacity is increased and the endurance in operation is improved.

In one illustrative embodiment of the present invention, there is provided a dash pot device which includes a body member having a partition wall defining a diaphragm chamber and an air chamber within the body member. The device further includes an air filter positioned within the air chamber, and a pinhole type orifice passage, functioning as a delay mechanism, installed in the partition wall.

In accordance with one feature of the present invention, since the air filter is positioned within the air chamber defined in the body member, muddy water is not directly absorbed by the filter, thereby reducing the occurrence of loading in the air filter.

In accordance with another feature of the present invention, an orifice passage is used as a delay mechanism, thereby greatly improving the delay capacity of the dash pot device in comparison with a labyrinth groove conventionally used. Furthermore, where a pinhole type orifice passage is adopted as the orifice passage, the restricted amount of flow does not vary widely in comparison with, for example, a needle type orifice passage. Therefore, the response is highly precise and the reliability in operation is high.

The above discussion as well as further objects and features of the invention will be understood more clearly and fully from the following detailed description of a preferred embodiment thereof, when read with reference to the accompanying drawings.

DETAILED DESCRIPTION OF THE PREFERRED EMBODIMENT

Figure 1:
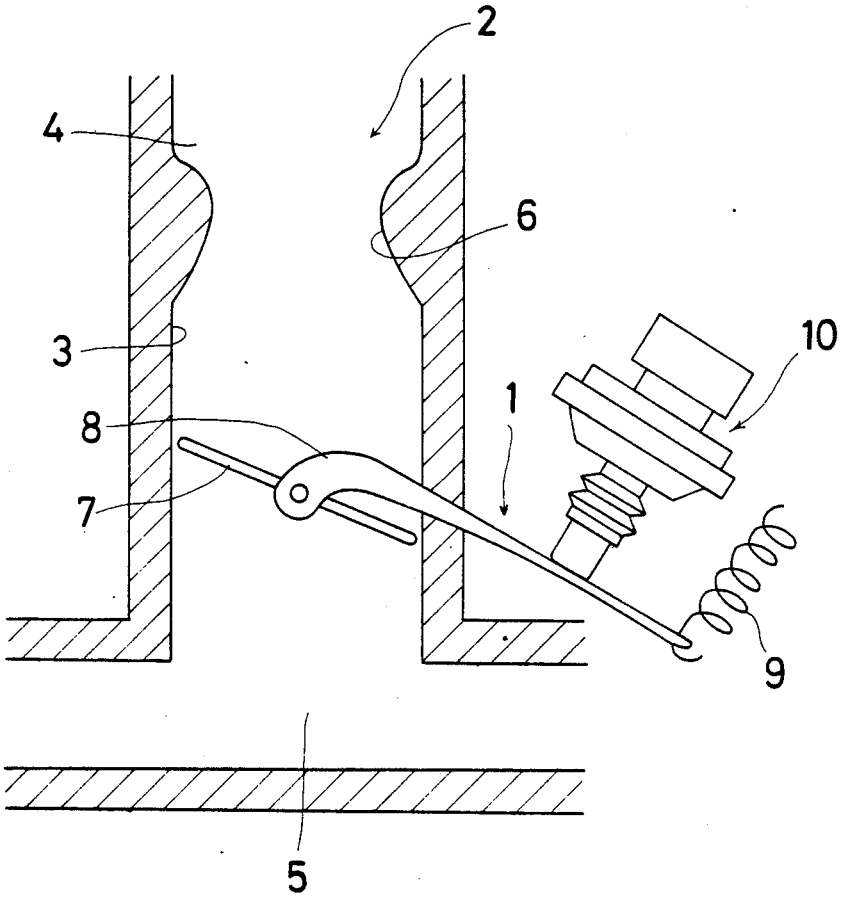
FIG. 1 is a fragmentary sectional view of a deceleration control system incorporating a dash pot device in accordance with the present invention.

Referring now to FIG. 1 showing a deceleration control system 1, a carburetor 2 is shown as being of the downdraft type having the usual air-fuel induction passage 3 with an atmospheric air inlet 4 at one end connected to the engine intake manifold 5 at the opposite end. The passage 3 contains the usual fixed area venturi 6 and a throttle valve 7 which is rotatably mounted on a part of the carburetor body across the passage 3.

A throttle lever 8 is connected with the throttle valve 7 at one end and is biased by a return spring 9 at the other end. More specifically, the throttle valve 7 is shown in its engine idle speed position essentially closing induction passage 3, and is rotatable with the throttle lever 8 against the biasing force of the return spring 9. The throttle lever 8 is in contact with a dash pot device 10 according to the present invention.

Figure 2:
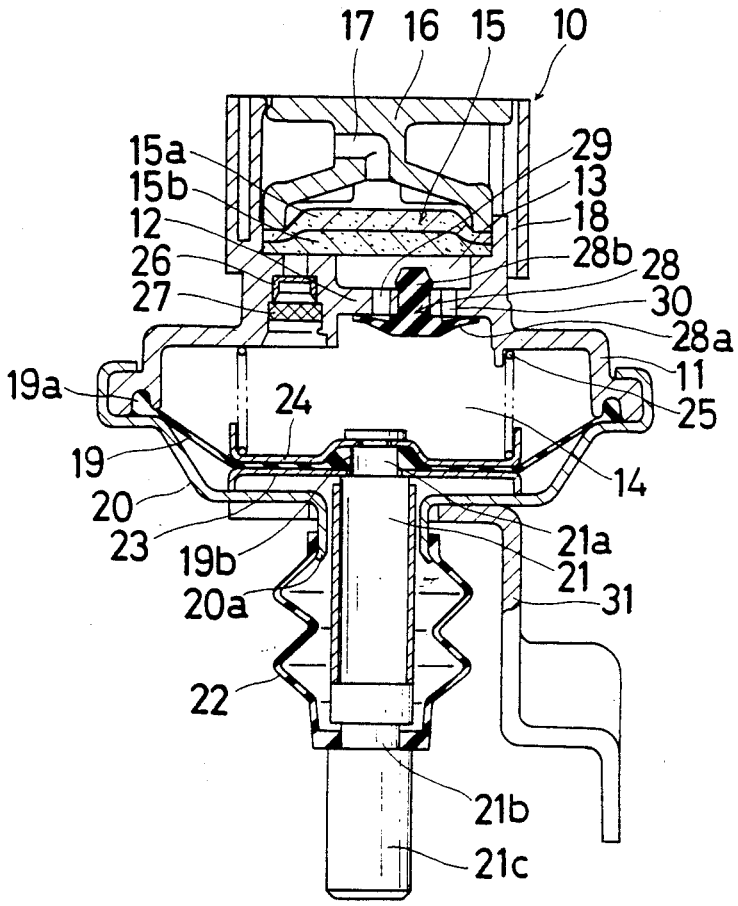
FIG. 2 is an enlarged longitudinal sectional view of the dash pot device in FIG. 1.

Referring to FIG. 2, there is illustrated a sectional view of the preferred embodiment of the dash pot device 10 which includes a body member 11 having a partition wall 12 therein which divides the interior of the body member 11 into an air chamber 13 and a diaphragm chamber 14. Positioned within the air chamber 13 is an air filter device 15 which includes a first filter **15*a* made of urethane material and a second filter 15*b* made of polyester material. The outer circumferential portion of air filter device 15 is secured by a cap member 16 having an air passage 17 through which an air opening 18 communicates with the air chamber 13**.

A diaphragm 19 disposed in the diaphragm chamber 14 is made of rubber or other suitable elastic material to enable movement of the center portion thereof. The outer periphery of the diaphragm 19 is rigidly secured between the body member 11 and a cover member 20 firmly connected with the body member 11. The center portion of the diaphragm 19 is provided with an axial hole **19*b* in which an upper portion 21*a* of a shaft 21 is securely inserted, whereby the shaft 21 can axially move together with the diaphragm 19. A bellows 22 made of rubber material is at the upper end thereof fastened to an annular portion 20*a* of the cover member 20 and at the lower end thereof fixed on a small diameter portion 21*b* of the shaft 21. The inner circumferential portion of the diaphragm 19 is clamped between a first metal plate 23 and a second metal plate 24. The first metal plate 23 functions as a stopper limiting downward movement of the shaft 21, while the second metal plate 24 supports a spring 25 which is positioned within the diaphragm chamber 14 to continuously bias the diaphragm 19** downwardly.

In the partition wall 12 of the body member 11 there is provided a pinhole type orifice member 26 forming an orifice passage through which the air chamber 13 communicates with the diaphragm chamber 14. The loading of the orifice member 26 can be effectively prevented by a sintered metal filter 27 installed in the partition wall at the diaphragm chamber side of the orifice member 26.

Installed in the partition wall 12 in parallel with the orifice member 26 is a check valve 28, consisting of an umbrella type seal having a flexible membrane 28*a* secured on an axial stem 28*b*, which permits fluid communication only in one direction from the air chamber 13 to the diaphragm chamber 14. In other words, when the check valve 28 is opened, the air chamber 13 communicates with the diaphragm chamber 14 through passages 29 and 30 formed in the partition wall 12.

A lower end 21*c* of the shaft 21 is to be connected with the throttle valve 7 by means of the throttle lever 8. The dash pot device 10 is mounted on a stationary portion of the engine by means of a member 31 connected with the cover member 20.

In operation, during engine idle the shaft 21 is pressed upwardly by the throttle lever 8 receiving the biasing force of the return spring 9. When the throttle valve 7 is rotated against the biasing force of the return spring 9 upon engine acceleration, the throttle lever 8 is separated from the shaft 21. As a result, the shaft 21 is moved downwardly by the biasing force of the spring 25. Accordingly, the diaphragm 19 is displaced downwardly to the position shown in FIG. 2, and the volume of the diaphragm chamber 14 is then increased, whereby vacuum pressure can be produced in the diaphragm chamber 14. Therefore, the check valve 28 is opened by the vacuum pressure, thereby permitting air to enter into the diaphragm chamber 14 from the air chamber 13.

Next, upon engine deceleration, namely upon the return movement of the throttle valve 7, the shaft is compulsively displaced upwardly by the throttle lever 8 receiving the biasing force of the return spring 9. Since the diaphragm 19 is displaced upwardly together with the shaft 21 against the biasing force of the spring 25, the volume of the diaphragm chamber 14 is reduced, whereby positive pressure can be produced in the diaphragm chamber 14 and the check valve 28 can then be closed by the positive pressure. Therefore, air flow from the diaphragm chamber 14 to the air chamber 13 is established only through the orifice passage 26 having a very low air flow velocity. Since the diaphragm 19 and the shaft 21 are slowly moved upwardly, the return action of the throttle valve 7 is temporarily delayed. Thus, the throttle valve 7 is gradually closed upon engine deceleration, thereby effectively reducing the output of undesirable exhaust gas elements.

It will be obvious to those skilled in the art that various changes may be made without departing from the spirit of the invention and therefore the invention is not limited to what is shown in the drawing and described in the specification, but only as indicated in the appended claims.

What is claimed is:

1. A dash pot device for delaying a return action of a carburetor throttle valve for automobile engines, comprising:

a body member having a partition wall dividing an interior of said body member into a diaphragm chamber and an air chamber;

a diaphragm disposed within said diaphragm chamber and movably mounted therein;

a shaft having one end fastened to said diaphragm and an end opposite said one end connected with said throttle valve;

said partition wall having a pinhole type orifice passage formed therein so as to establish fluid communication between said air chamber and said diaphragm chamber;

a check valve installed in said partition wall in parallel with said orifice passage so as to permit communication only in one direction from said air chamber to said diaphragm chamber;

a cap member for closing said air chamber and having an air passage formed therein;

air filter means disposed within said air chamber, positioned between said air passage, said check valve and said orifice passage, and secured by said cap member; and a sintered metal filter positioned in said orifice passage at a diaphragm chamber side thereof.

2. A dash pot device according to claim 1, wherein said air filter means includes a first filter made of urethane material and a second filter made of polyester material.

3. A dash pot device according to claim 1, further comprising a cover member connected with said body member and a bellows made of rubber material and having one end fastened to said cover member and an end opposite said one end fixed on said shaft.

4. A dash pot device according to claim 1 wherein said check valve includes an umbrella type seal having an axial stem and a flexible membrane secured on said axial stem.

5. A dash pot device according to claim 1, further comprising a spring positioned within said diaphragm chamber so as to continuously bias said diaphragm.

6. A dash pot device according to claim 5, further comprising means for clamping said diaphragm between a first metal plate functioning as a stopper for limiting axial movement of said shaft and a second metal plate supporting said spring.

7. A dash pot device according to claim 5, further comprising a cover member connected with said body member and a bellows made of rubber and having one end fastened to said cover and an end opposite said one end fixed on said shaft.

* * * * *